US005695845A

United States Patent [19]

Ogawa et al.

[11] Patent Number: 5,695,845

[45] Date of Patent: Dec. 9, 1997

[54] FOAMED BODY FASTENER

[76] Inventors: Taro Ogawa, 3-52, Kojima Ajinokami 1-chome, Kurashiki-city, Okayama Prefecture 711, Japan; Fumio Goto, 829-4, Kushida, Kurashiki-city, Okayama Prefecture 711, Japan

[21] Appl. No.: 530,339

[22] PCT Filed: Sep. 6, 1994

[86] PCT No.: PCT/JP94/01472

§ 371 Date: Sep. 21, 1995

§ 102(e) Date: Sep. 21, 1995

[87] PCT Pub. No.: WO95/20335

PCT Pub. Date: Aug. 3, 1995

[30] Foreign Application Priority Data

Jan. 27, 1994 [JP] Japan ..... 6-024808

[51] Int. Cl.[6] ..... B32B 3/02; B32B 3/06; B32B 5/14; A44B 1/04

[52] U.S. Cl. ..... 428/93; 428/100; 428/306.6; 428/308.4; 428/309.9; 24/442; 24/448

[58] Field of Search ..... 428/93, 100, 306.6, 428/308.4, 309.9; 24/442, 448

[56] References Cited

U.S. PATENT DOCUMENTS

| | | | |
|---|---|---|---|
| 3,385,751 | 5/1968 | Willard et al. | 428/95 |
| 4,067,609 | 1/1978 | Ness | 24/442 |
| 4,216,257 | 8/1980 | Schams et al. | 428/93 |
| 4,290,174 | 9/1981 | Kalleberg | 24/448 |
| 4,454,183 | 6/1984 | Wollman | 428/100 |
| 4,717,611 | 1/1988 | Petrella et al. | 428/100 |
| 4,770,917 | 9/1988 | Tochacek et al. | 428/100 |
| 4,931,343 | 6/1990 | Becker et al. | 428/100 |
| 5,101,539 | 4/1992 | Kennedy et al. | 24/442 |
| 5,149,573 | 9/1992 | Kobe et al. | 428/100 |
| 5,436,051 | 7/1995 | Donaruma et al. | 428/100 |

FOREIGN PATENT DOCUMENTS

| | | |
|---|---|---|
| 0 211 564 | 2/1992 | European Pat. Off. . |
| 2 285 093 | 6/1995 | United Kingdom . |

*Primary Examiner*—Terrel Morris

*Attorney, Agent, or Firm*—Renner, Kenner, Greive, Bobak, Taylor & Weber

[57] ABSTRACT

A foamed molding having a fastener comprises: a foamed body (41), pile threads (42) each having a leading end protruding from the front side of the first foamed body and a rear end exposing from the back side of the first foamed body, and a foamed body (60) formed on the back side of the foamed body (41). The pile threads (41) each have an extended portion (43) for locking at the leading end thereof. A part of stock solution for forming the foamed body (60) is impregnated from the back side of the foamed body (41) to thereby form an impregnated layer (61) between the foamed body (41) and the foamed body (60), the impregnated layer (61) functioning to secure the rear ends of the pile threads (42). The foamed molding having a fastener can follow a contraction phenomenon produced in the foaming process of foam resin when an impregnated type foamed molding is formed on the back side of the face-like fastener.

8 Claims, 4 Drawing Sheets

FOAMED BODY FASTENER

TECHNICAL FIELD

The present invention relates to a fastener and, in particular, relates to a face-like fastener for attaching a skin sheet material to a foamed molding body.

BACKGROUND OF THE ART

In seats used in a car and an aircraft, chairs used in a house and an office, an upholstery foam lining, an interior finish for a floor and a wall, and the like, a face-like fastener is used for attaching a skin sheet material to a cushion material. Upon this, the skin sheet material can be detached from the cushion material. In general, such a face-like fastener comprises one member having many pile threads with hook- or mushroom-shaped expanded portions and another member having many loops for locking with those expanded portions.

FIG. 1 shows a partial cross-sectional view of a fastener according to the art wherein one member of the face-like fastener is provided on a cushion material surface. The face-like fastener 1 has pile threads 4 entangled with a woven-fabric 3, and each pile thread 4 has a mushroom-shaped pileus 5 on its leading end. A cushion material 2 is provided on the back side of the woven-fabric 3. The cushion material 2 is molded in one with the woven-fabric 3 by foam resin such as polyurethane.

Another member of the fastener is provided on a skin sheet material. Many loops are formed on this member and are locked or hooked with the pilei, and the skin sheet material can be attached to the cushion material thereby. However, when an external force acts between the cushion material and the skin sheet material attached thereto, the pile threads 4 will be taken out from the woven-fabric 3. Thus, the pile threads and the fabric should be fixed to resist such an external force in order to perform a good fastening without the pile threads being taken out therefrom. Accordingly, in a fastener of the art, as seen in FIG. 2(*a*), a backing 6 made of acryl resin is provided on the back side of the woven-fabric 13.

We now consider another fastener which uses a knitted-fabric as shown in FIG.2(*b*) other than a fastener formed by entangling the pile threads with the woven-fabric as shown in FIG. 1 or FIG. 2(*a*). In a fastener using a knitted-fabric, ends of a string of the knitted-fabric is protrude from the surface of the knitted-fabric, and pile threads 14 are formed by such ends and a pileus 15 is formed on each tip thereof. The pile threads 14 of the fastener comprising of such a knitted-fabric are not taken out therefrom by the external force, however, when such a force acts to the pile threads 14, the pile threads 14 are pulled, and the knitted-fabric cloth and the pile threads are slid thereby. In order to avoid this, a backing 16 is provided on the back side of the knitted-fabric by the resin processing as mentioned in the woven-fabric case.

As described in the above, while a cushion material is molded by foam resin such as polyurethane, it is contracted by a few percent (e.g. about 1.5% in urethane foam ) in a series of steps of injecting the stock solution of the resin onto the back side of the woven- or the knitted-fabric, foaming and then setting. Meanwhile, the back side of the woven- or the knitted-fabric can not follow such a contraction phenomenon because the backing provided on the back side is made by the resin processing. Thus, the front side is waved so that if a skin sheet material is attached to the face-like fastener having the wariness the skin sheet material is also waved, and the exterior view and the quality of a seat and the like are considerably spoiled thereby.

Moreover, such a waviness formed on a skin sheet of a seat or a chair makes the exterior view of the seat worse and makes a person who sits thereon uncomfortable.

In use of a knitted-fabric, its cloth is itself stretchable and so even if the backing is made by the resin processing, the contraction phenomenon of the foam resin may be reduced. However, in a fastener using a cloth of the knitted-fabric, its structure and its production process are complicated, and its cost is higher and its use is considerably limited thereby.

Therefore, an object of the present invention is to provide a face-like fastener having contractility and elasticity.

Another object of the present invention is to provide a face-like fastener having elasticity although a fixing layer is formed on the back side thereof to fix rear ends of pile threads having expanded portions.

Still another object of the present invention is to provide a foamed molding body having a face-like fastener, wherein the foamed molding body can follow the contraction phenomenon caused in a step of foaming a foam resin when integrally forming the foamed molding body on the back side of the face-like fastener so that a wariness is not formed on the surface thereof, and the feeling of the surface is good.

DISCLOSURE OF THE INVENTION

In order to accomplish those objects, a foamed body fastener according to the present invention comprises a foamed body and thread-like fastening materials passing through the foamed body. A leading end of each thread-like fastening material is protruded from the front side of the foamed body and a rear end of each thread-like fastening material is exposed from the back side of the foamed body. The leading end of each thread-like fastening material has an expanded portion for fastening or locking. A fixing layer is formed on the back side of the foamed body to fix the rear end of each thread-like fastening material.

A foamed molding body having a fastener according to the present invention comprises a first foamed body, thread-like fastening materials whose leading ends are protruded from the front side of the first foamed body and whose rear ends are exposed from the back side of the first foamed body, and a second foamed body formed by foaming on the back side of the first foamed body. The foamed molding body having a fastener further includes an expanded portion for fastening which is provided on the leading end portion of each thread-like fastening material and an impregnated layer formed between the first foamed body and the second foamed body by impregnating a part of stock solution of the second foamed body from the back side of the first foamed body, whereby the rear ends of the thread-like fastening materials are fixed by the impregnated layer.

Upon this, a fixing layer may be formed between the first foamed body and the second foamed body to fix the rear ends of the thread-like fastening materials. The expanded portion is a pileus spreading horizontally or downward.

The first foamed body may be a molded body of foam resin made by open cell or closed cell. The thickness of the first foamed body is preferably about 2 mm to 20 mm. Pile threads can be used for the thread-like fastening materials, and the pile threads are made of a thermoplastic resin such as polypropylene resin, polyethylene resin or the like.

The stock solution of the second foamed body may be an active resin foam or a non-active resin foam. The fixing layer may be formed by a solution or a non-solution resin or a polymer material.

A foamed body of a fastener according to the present invention is contractible and is elastic, and thus, although the fixing layer is formed to fix the rear ends of the thread-like fastening materials, the comfortableness and the exterior view can be maintained. Moreover, while when the foamed molding body is formed on the back side of the fastener the impregnated layer is formed by impregnating a part of stock solution of foam resin from a foamed body of the fastener, the foamed body of the fastener can absorb the contraction phenomenon caused by settling and foaming the stock solution of the foamed molding body.

BEST MODE FOR CARRYING OUT THE INVENTION

Figure 1:
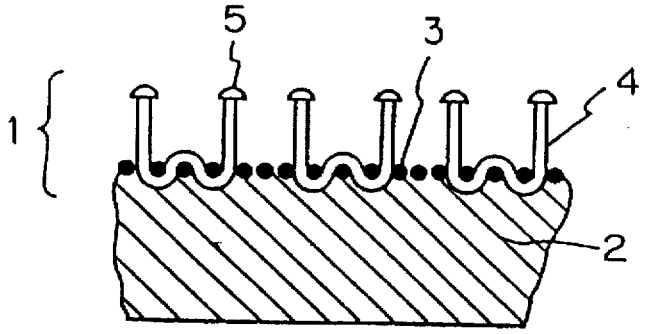
FIG. 1 (PRIOR ART)
FIG. 1 shows a partial sectional view of a fastener formed on a foamed body, according to the art.
Figure 2A:
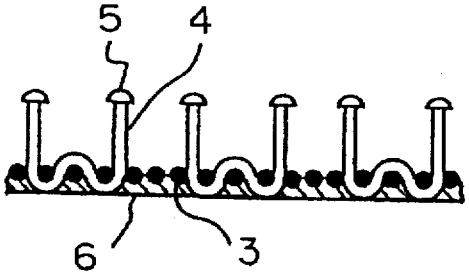
FIG. 2(a) (PRIOR ART)
FIG. 2 (*a*) shows a partial sectional view of a fastener using a woven-fabric, and FIG. 2(*b*) shows a partial sectional view of a fastener using a knitted-fabric, according to the art.
Figure 2B:
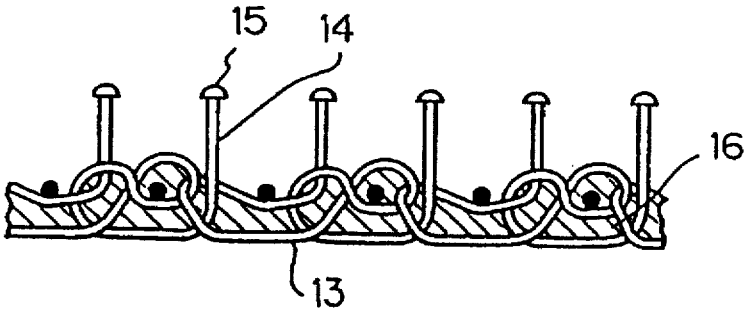
FIG. 2(b) (PRIOR ART)
Figure 3A:
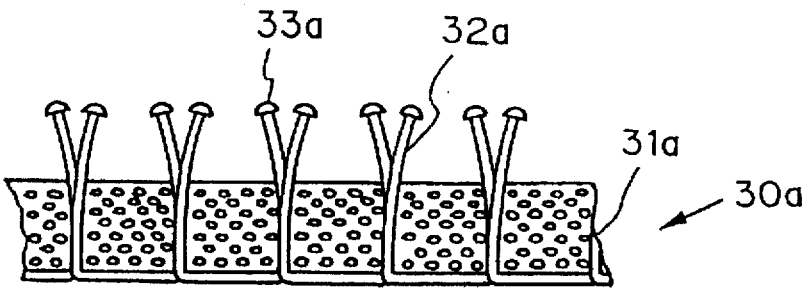
FIGS. 3 (*a*)–(*d*) shows a partial sectional views of foamed body fastener, according to the present invention.
Figure 3B:
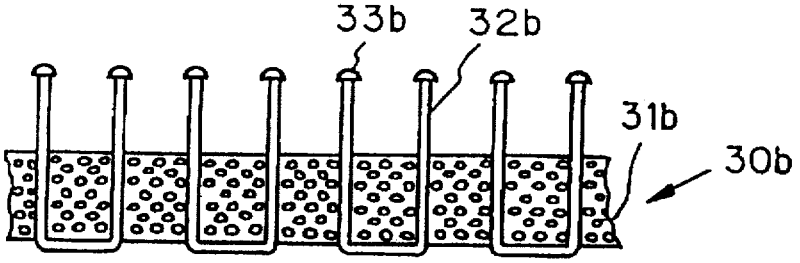
Figure 3C:
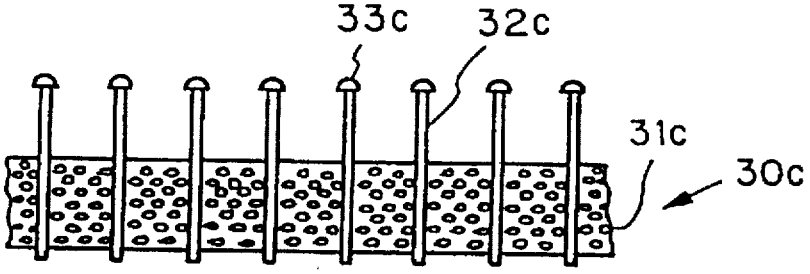
Figure 3D:
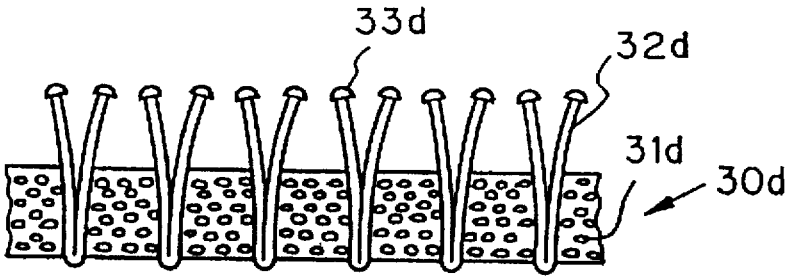

FIGS. 3(*a*)–(*d*) show the foamed fastener according to the present invention. A fastener 30*a* of FIG. 3(*a*) comprises a face-like foamed body 31*a* such as a slab material made of urethane foam having the elasticity and a pair of pile threads 32*a* of a thread-like fastening material protruding from front side thereof. In this figure, one pile thread 32*a* of the pair overlaps another pile thread in the foamed body 31*a*. The rear end of the pile thread 32*a* is exposed from the back side of the foamed body 31*a* and is connected with a rear end of a pile thread adjacent to the pile thread 32*a*. The leading end of the pile thread 32*a* has an expanded portion which is comprised of a pileus 33*a*. The pileus 33*a* has a mushroom-like shape spreading horizontally or downward so that the pileus 33*a* can be locked and hooked with a loop provided on another member of the fastener.

In this embodiment, as seen in the figures, each pile thread simply protrudes from the foamed body, and it is unnecessary to entangle with each pile thread thereby, in contrast with use of woven fabric and knitted fabric. That is, its structure is simplified, and the production process is also considerably simplified, as described in the following. Thus, the cost for producing is reduced.

The foamed body may be made of open cell or closed cell, and its thickness is preferably 2 mm to 20 mm.

In a fastener 30*b* of another embodiment shown in FIG. 3(*b*) different from the embodiment of FIG. 3(*a*), each pile thread 32*b* is independently protruded from a foamed body 31*b*. Each leading end thereof has a mushroom-shaped pileus 33*b* and the rear end thereof is connected with a rear end of a pile thread adjacent to the pile thread 33*b*.

In a fastener 30*c* of another embodiment shown in FIG. 3(*c*), a leading end of pile thread 32*c* is protruded from a foamed body 31*c* and a rear end of the pile thread 32*c* is exposed from the back side thereof.

In a fastener 30*d* of another embodiment shown in FIG. 3(*d*), each pile thread 32*d* is curved like a hair-pin and two leading ends of the pile thread 32*d* are protruded from the front side of a foamed body 31*d* and its curved portion is exposed from the back side thereof.

In those embodiments shown in FIGS. 3(*b*)–(*d*), likewise the embodiment shown in FIG. 3(*a*), it is unnecessary to entangle with each pile thread and the structure and the production processes are considerably simplified, and the cost for producing is reduced thereby.

In those embodiments, while each embodiment is described by one member having a fastener which has a pileus provided on a leading end of each pile thread to fasten or lock, the pileus may be substituted with a hook.

Also, in those embodiments, while each embodiment is described by providing the pile thread in only one foamed body, a film or a fabric material such as a thin cloth, a non-woven fabric and the like may be alternatively provided by laminating on one side, on both sides or inside of the foamed body. Since the foamed body is contractible and is elastic, although laminating such a fabric material or a film, the performance as a cushion is not spoiled.

Additionally, while the foamed body has a planar surface, the foamed body may have a curved surface.

In a fastener according to the present invention, in order to fix pile threads and, in particular, to fix pile threads shown in FIG. 3(*c*) or (*d*), a fixing layer is formed on the back side of the foamed body by coating or laminating a contractible resin such as latex, elastomers, or polymer materials such as vinyl or phenol rubber, so that the rear ends of the pile threads exposed from the back side thereof are fixed.

Figure 7:
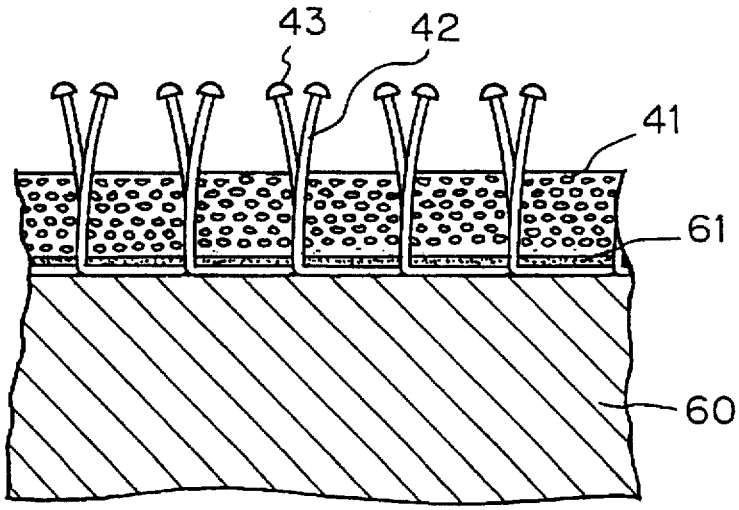
FIG. 7 shows a partial cross-sectional view of a molded foamed body having a foamed body fastener.

A foamed body having a fastener according to the present invention is made of injecting a stock solution of foam resin on the back side of the aforementioned fastener of the present invention and then foaming and molding. In FIG. 7, a foamed molding body having a fastener is shown. As shown in FIG. 7, when forming this foamed molding body 60, an impregnated layer 61 is formed by impregnating a part of stock solution of the foam resin from the back side of the fastener. While the impregnated layer 61 is contractible, the impregnated layer has a higher density than the foamed body around the impregnated layer and becomes a hardening layer, so that the rear ends of the pile threads 42 exposed from the back side of a foamed layer 41 are fixed on the foamed layer 41.

While the foamed molding body of FIG. 7 is made of injecting directly the stock solution of the foam resin on the back side of the foamed body of the fastener to form the foamed molding body and simultaneously to form the impregnated layer, it may be made of forming a fixing layer for fixing the rear ends of the pile threads on the back side of the foamed body of the fastener and then injecting the stock solution of the foam resin on the fixing layer to form the foamed molding body thereon. In this case, the rear ends of the pile threads are fixed by the fixing layer, and the thin impregnated layer can be formed thereby.

While the contraction phenomenon is caused as described in the art when the foamed molding body is formed, the foamed body 41 can absorb such a contraction, and the contractile effect does not affect the front side of the foamed body 41 thereby. Thus, the waviness of the front side as formed in a fastener of the art does not appear in the foamed molding body of the present invention. While an active resin foam such as a polyurethane foam, a polyurea foam and the like are used as the resin foam for the foamed molding body, a polyethylene foam, a non-active resin foam such as a polypropylene foam and the like are also used.

The foamed molding body can be made with several shapes and hardness, and thus, the foamed molding body of the present invention can be applied for seats and chairs made by attaching a skin sheet material to a cushion material, an upholstery foam lining, an interior finish for a floor and a wall and the like.

We now consider a process of producing a fastener and a foamed molding body having the fastener of the present invention, with references to FIGS. 4–7.

Figure 4:
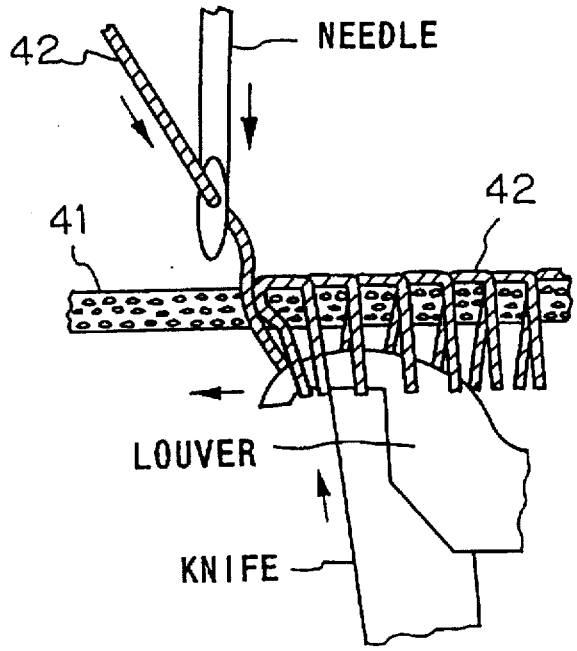
FIG. 4 shows a process of forming tufts of a polypropylene thread on a foamed body.

A slab material having the thickness of 10 mm and the density of 0.035 g/cm$^3$ is used as the foamed body of the fastener, and a polypropylene thread having the diameter of f0.28 is used as the pile thread. As shown in FIG. 4, tufts having a needle pitch or a stitch interval of 3 mm are formed on the foamed body 41. The polypropylene thread 42 passes through the foamed body 41 by stitch to form loops on the back side thereof. Those loops are cut automatically.

While in FIG. 4 the foamed body 41 is directly applied to the machine for forming tufts thereon, a thin cloth and a non-woven fabric such as nylon half or a contractible film may be attached on the surface or inside of the foamed body to smoothly transfer the foamed body.

Figure 5:
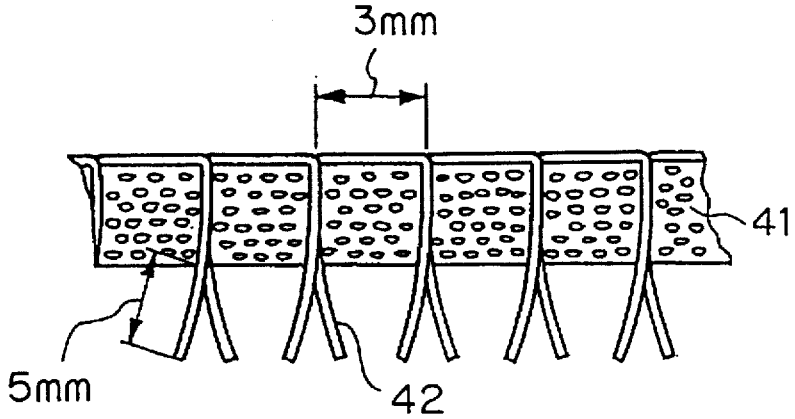
FIG. 5 shows a foamed body wherein the end of each tufting thread made of polypropylene is protruded from the front side thereof.

As shown in FIG. 5, both leading ends of each thread protrude from the front side of the foamed body 41 and its rear end is exposed from the back side thereof. Upon this, the length of the pile thread protruding from the front side thereof is adjusted by 5 mm. After the process of forming the tufts, by heating the leading end portion of the polypropylene thread 42, the length of the leading end is reduced by 2–2.5 mm, and then a pileus 43 is formed on the leading end and is shaped as a mushroom spreading horizontally or downward (see FIG. 6 ) This end can be locked to and unlocked with a loop formed on a back side of the skin sheet material.

Figure 6:
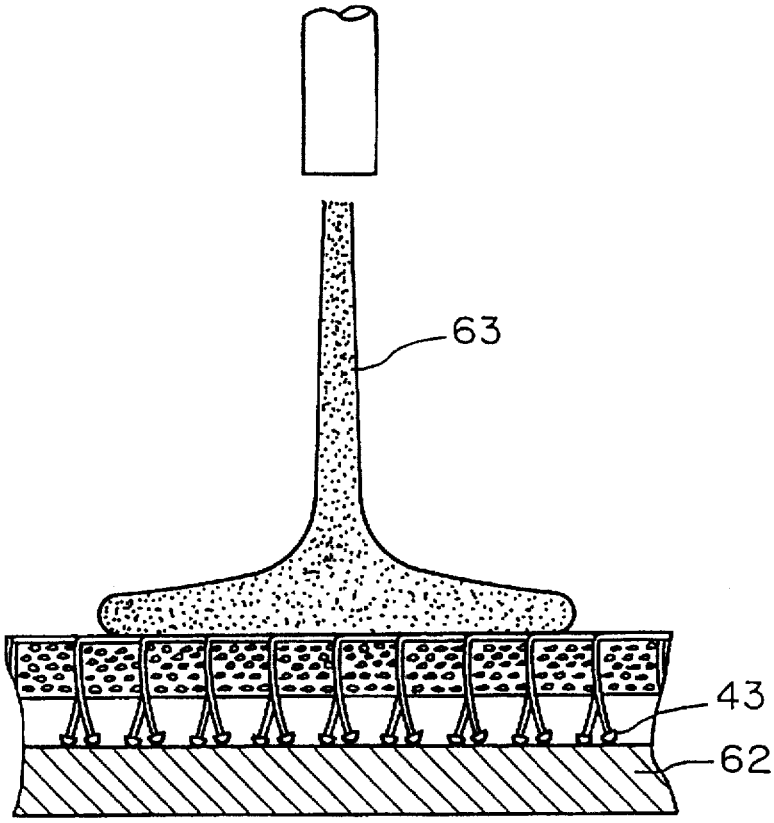
FIG. 6 shows a process of injecting a stock solution of foam resin onto the rear face of a foamed body fastener.

The foamed body 41 stitching the polypropylene thread therein having a desired shape and dimension is obtained by cutting the foamed body 41. Then, the pileus 43 of the polypropylene thread is directed downward and the foamed body 41 is located in a molding die 62, as shown in FIG. 6. Then, a stock solution 63 of a polyurethane foam as the foam resin is injected thereon. At this instance, a part of stock solution is impregnated into the foamed body 41 through the front side thereof, and the impregnated layer 61 is formed thereby (FIG. 7 ).

Because the impregnated layer has a high density and is hardened, the end of the polypropylene thread stitched therein is securely fixed so that the threads are not taken out therefrom. Thus, a foamed molding body which is integrally molded on the foamed body fastener is obtained.

The polypropylene thread stitched therein would be slid until the foamed molding body is integrally formed on the foamed body of the fastener, however this is avoided by spraying a contractible resin such as latex on the foamed body fastener suitably after completing the process of forming the tufts.

The foamed body fastener of the present invention has a simple structure as described in the above and so can be produced by low cost. Also, the foamed body of the fastener is contractible and elastic, and although the fixing layer for fixing the pile threads is formed, the performance as a cushion and the exterior view can be maintained thereby.

Moreover, a foamed molding body can be formed on the back side of the fastener. When forming the foamed molding body thereon an impregnated layer is formed by impregnating a part of stock solution of foam resin of the foamed molding body into the foamed body of the fastener, and the rear ends of the pile threads are fixed by the impregnated layer, and the pile threads are not taken out and are not slid thereby.

Furthermore, the foamed body of the fastener can absorb the contraction phenomenon caused by foaming and hardening the stock solution of the foamed molding body, and the waviness is not formed on the front side thereby. Also, the foamed molding body can be shaped into several shapes, and the molded body of the fastener can apply for many uses thereby.

We claim:

1. A foamed molding body having a fastener comprising:

a first foamed body having a front side and a back side;

thread fastening materials having leading ends thereof protruding from said front side of said first foamed body and having rear ends thereof exposed at said back side of said first foamed body; and a second foamed body formed by foaming on said back side of said first foamed body, an expanded portion for fastening provided on said leading end of said thread fastening materials; and an impregnation layer formed between said first foamed body and said second foamed body by impregnating a part of the foam forming said second foamed body in said back side of said first foamed body, said impregnation layer fixing said rear ends of said thread fastening materials.

2. A foamed molding body fastener according to claim 1, wherein said expanded portion is a pileus spreading horizontally or downward.

3. A foamed molding body fastener according to claim 1, wherein said rear end of each of said thread fastening materials is connected with a rear end of another of said thread fastening materials adjacent to each of said thread fastening materials.

4. A foamed molding body fastener according to claim 1, wherein said first foamed body is a molded body made of open or closed cell foamed resin, and wherein the thickness of said first foamed body is about 2 mm to 20 mm.

5. A foamed molding body fastener according to claim 1, wherein said thread fastening materials are pile thread made of thermoplastic resin.

6. A foamed molding body fastener according to claim 5, wherein said thermoplastic resin is polypropylene resin or polyethylene resin.

7. A foamed molding body fastener according to claim 1, wherein said second foamed body fastener is formed of an active resin foam.

8. A foamed molding body fastener according to claim 1, wherein said second foam body is formed of a non-active resin foam.

* * * * *